US011170677B2

(12) United States Patent
Li

(10) Patent No.: US 11,170,677 B2
(45) Date of Patent: Nov. 9, 2021

(54) CLOCK SIGNAL TEST CIRCUIT, CONTROL METHOD THEREOF, DISPLAY PANEL AND TEST DEVICE

(71) Applicant: BOE Technology Group Co., Ltd., Beijing (CN)

(72) Inventor: Yongqian Li, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/040,972

(22) PCT Filed: Mar. 3, 2020

(86) PCT No.: PCT/CN2020/077621
§ 371 (c)(1),
(2) Date: Sep. 23, 2020

(87) PCT Pub. No.: WO2020/177688
PCT Pub. Date: Sep. 10, 2020

(65) Prior Publication Data

US 2021/0090481 A1 Mar. 25, 2021

(30) Foreign Application Priority Data

Mar. 6, 2019 (CN) ..... 201910169366.4

(51) Int. Cl.
*G09G 3/00* (2006.01)
*G09G 3/20* (2006.01)

(52) U.S. Cl.
CPC ..... *G09G 3/006* (2013.01); *G09G 3/20* (2013.01); *G09G 2300/0426* (2013.01);
(Continued)

(58) Field of Classification Search
None
See application file for complete search history.

(56) References Cited

U.S. PATENT DOCUMENTS

2009/0158076 A1 6/2009 Chejara
2010/0066383 A1 3/2010 Chung et al.
(Continued)

FOREIGN PATENT DOCUMENTS

CN 101364022 A 2/2009
CN 202210402 U 5/2012
(Continued)

OTHER PUBLICATIONS

International Search Report for PCT/CN2020/077621 dated Jun. 9, 2020.
(Continued)

*Primary Examiner* — Ifedayo B Iluyomade
(74) *Attorney, Agent, or Firm* — Ling Wu; Stephen Yang; Ling and Yang Intellectual Property

(57) ABSTRACT

The present application discloses a clock signal test circuit, a control method thereof, a display panel and a test device. The clock signal test circuit comprises: N clock control signal lines; M control sub-circuits, each of which includes at least two control branches, wherein each of the control branches is configured to output a signal input from the input signal line to the corresponding output signal line under the control of a signal input from the corresponding clock control signal line; and a pull-down sub-circuit including N pull-down branches, wherein each of the pull-down branches is configured to output the first power supply voltage to the corresponding output signal line under the control of the signal input from the corresponding clock control signal line.

10 Claims, 7 Drawing Sheets

(52) U.S. Cl.
CPC . *G09G 2300/08* (2013.01); *G09G 2310/0267* (2013.01); *G09G 2310/08* (2013.01); *G09G 2330/02* (2013.01)

(56) References Cited

U.S. PATENT DOCUMENTS

| | | | | |
|---|---|---|---|---|
| 2018/0190178 | A1 | 7/2018 | Hong et al. | |
| 2018/0261164 | A1 | 9/2018 | Zhu et al. | |
| 2019/0027079 | A1* | 1/2019 | Shang | G11C 19/287 |
| 2020/0160768 | A1 | 5/2020 | Wang et al. | |
| 2020/0279516 | A1 | 9/2020 | Weng et al. | |

FOREIGN PATENT DOCUMENTS

| | | | |
|---|---|---|---|
| CN | 104793795 | A | 7/2015 |
| CN | 106128349 | A | 11/2016 |
| CN | 107316603 | A | 11/2017 |
| CN | 107749276 | A | 3/2018 |
| CN | 108109566 | A | 6/2018 |
| CN | 108447450 | A | 8/2018 |
| CN | 207781163 | U | 8/2018 |
| CN | 108831360 | A | 11/2018 |
| CN | 109256081 | A | 1/2019 |
| CN | 109741703 | A | 5/2019 |

OTHER PUBLICATIONS

Dffice Action dated Apr. 17, 2020 for Chinese Patent Application No. 201910169366.4 and English Translation.
Decision to Grant dated Aug. 11, 2020 for Chinese Patent Application No. 201910169366.4 and English Translation.

* cited by examiner

CLOCK SIGNAL TEST CIRCUIT, CONTROL METHOD THEREOF, DISPLAY PANEL AND TEST DEVICE

CROSS-REFERENCE TO RELATED APPLICATION

The present application is a U.S. National Phase Entry of International Application No. PCT/CN2020/077621 having an international filing date of Mar. 3, 2020, which is based on and claims priority to the Chinese Patent Application No. 201910169366.4, filed on Mar. 6, 2019. The above-identified applications are incorporated herein by reference in their entirety.

TECHNICAL FIELD

The present application relates to the field of display technology, and in particular, to a clock signal test circuit and a control method thereof, a display panel and a test device.

BACKGROUND

A display panel usually includes a plurality of gate lines and a plurality of data lines, interleaved in a mutually perpendicular manner. One or more pixels are provided at a position where each of the gate lines intersects with each of the data lines. Whether a signal on a data line is written into the pixel(s) can be controlled by driving a switch of a gate transistor on the gate line by a gate drive circuit, thereby achieving the purpose of displaying the pixel(s).

SUMMARY

The present application is intended to solve one of the technical problems in the related art at least to some extent.

To this end, a first object of the present application is to provide a clock signal test circuit.

A second object of the present application is to provide a display panel.

A third object of the present application is to provide a display device.

A fourth object of the present application is to provide a method for controlling a clock signal test circuit.

In order to achieve the above objects, an embodiment in accordance with a first aspect of the present application provides a clock signal test circuit, which includes N clock control signal lines; M control sub-circuits, each of which includes at least two control branches, wherein input terminals of the at least two control branches are all connected to the same input signal line, control terminals of the at least two control branches are coupled to at least two of the N clock control signal lines respectively, output terminals of the at least two control branches are connected to at least two output signal lines respectively, and each of the control branches is configured to output a signal input from the input signal line to the corresponding output signal lines under the control of a signal input from the corresponding clock control signal line, wherein the number of control branches of at least one of the control sub-circuits is N, both M and N being integers greater than 1; and a pull-down sub-circuit including N pull-down branches, input terminals of which all receive a first power supply voltage, wherein an output terminal of each of the N pull-down branches is connected to an output signal line of at least one of the control sub-circuits, control terminals of the N pull-down branches are connected to the N clock control signal lines respectively, and each of the pull-down branches is configured to output the first power supply voltage to the corresponding output signal line under the control of the signal input from the corresponding clock control signal line.

According to an embodiment of the present application, each of the control sub-circuits includes N control branches, wherein input terminals of the N control branches are all connected to the same input signal line, control terminals of the N control branches are coupled to the N clock control signal lines respectively, output terminals of the N control branches are connected to N output signal lines respectively, wherein the output terminal of each of the pull-down branches is connected to output signal lines of the M control sub-circuits.

According to an embodiment of the present application, an $i^{th}$ control branch in each of the control sub-circuits includes an $i^{th}$ transistor, wherein a first electrode of the $i^{th}$ transistor is connected to the input signal line, a second electrode of the $i^{th}$ transistor is connected to an $i^{th}$ output signal line, and a control electrode of the $i^{th}$ transistor is connected to an $i^{th}$ clock control signal line, wherein i is an integer greater than or equal to 1 and less than or equal to N.

According to an embodiment of the present application, an $i^{th}$ pull-down branch in the pull-down sub-circuit includes an inverter, an input terminal of which is connected to the $i^{th}$ clock control signal line; and an $(N+i)^{th}$ transistor, wherein a first electrode of the $(N+i)^{th}$ transistor is connected to a first power supply providing the first power supply voltage, a second electrode of the $(N+i)^{th}$ transistor is connected to an output signal line of at least one of the control sub-circuits, and a control electrode of the $(N+i)^{th}$ transistor is connected to an output terminal of the inverter.

According to an embodiment of the present application, the inverter includes a $(2N+1)^{th}$ transistor, a first electrode and a control electrode of the $(2N+1)^{th}$ transistor being connected to a second power supply; and a $(2N+2)^{th}$ transistor, wherein a control electrode of the $(2N+2)^{th}$ transistor serves as the input terminal of the inverter, a first electrode of the $(2N+2)^{th}$ transistor is connected to a second electrode of the $(2N+1)^{th}$ transistor and then serves as the output terminal of the inverter, and a second electrode of the $(2N+2)^{th}$ transistor is connected to a third power supply.

According to an embodiment of the present application, the inverter includes a $(2N+3)^{th}$ transistor, a first electrode and a control electrode of which are connected to a second power supply; a $(2N+4)^{th}$ transistor, wherein a first electrode of the $(2N+4)^{th}$ transistor is connected to a second electrode of the $(2N+3)^{th}$ transistor, and a second electrode of the $(2N+4)^{th}$ transistor is connected to a third power supply; a $(2N+5)^{th}$ transistor, wherein a first electrode of the $(2N+5)^{th}$ transistor is connected to the second power supply, and a control electrode of the $(2N+5)^{th}$ transistor is connected to the second electrode of the $(2N+3)^{th}$ transistor; and a $(2N+6)^{th}$ transistor, wherein a control electrode of the $(2N+6)^{th}$ transistor is connected to a control electrode of the $(2N+4)^{th}$ transistor and then serves as the input terminal of the inverter, a first electrode of the $(2N+6)^{th}$ transistor is connected to a second electrode of the $(2N+5)^{th}$ transistor and then serves as the output terminal of the inverter, and a second electrode of the $(2N+6)^{th}$ transistor is connected to the third power supply.

According to an embodiment of the present application, in the first stage, the signals input from the input signal lines are kept at a first level, and the N clock control signal lines input turn-on control signals sequentially, to enable the at least two control branches in each of the control sub-circuits to be turned on sequentially, wherein while a clock control signal line inputs a turn-on control signal, other clock control signal lines input turn-off control signals, and the pull-down branches output the first power supply voltage to the corresponding output signal lines under the control of the turn-off control signals input from the clock control signal lines; in the second stage, the signals input from the input signal lines are kept at a second level, and each of the output signal lines outputs a second-level signal, wherein a voltage at the second level is the same as the first power supply voltage.

In order to achieve the above objects, an embodiment in accordance with a second aspect of the present application provides a display panel, which includes a gate drive circuit; and the clock signal test circuit described in the embodiment in accordance with the first aspect of the present application, which is configured to be connected to the gate drive circuit in a test stage.

According to an embodiment of the present application, the gate drive circuit includes at least one set of gate drive units, wherein each set of gate drive units includes a first gate drive unit to an $N^{th}$ gate drive unit, and each of gate drive unit has M clock signal terminals. The M control sub-circuits in the clock signal test circuit correspond to the M clock signal terminals respectively, and at least two output terminals of each control sub-circuit are respectively connected to clock signal terminals, corresponding to the control sub-circuit, of at least two of gate drive units in each set of gate drive units.

In order to achieve the above objects, an embodiment in accordance with a third aspect of the present application provides a test device, which includes the clock signal testing circuit described in the embodiment in accordance with the first aspect of the present application.

In order to achieve the above objects, an embodiment accordance with a fourth aspect of the present application provides a method for controlling the clock signal test circuit described in the embodiment in accordance with the first aspect of the present application, wherein in the first stage, a signal input from the input signal line is kept at a first level, and the N clock control signal lines input turn-on control signals sequentially, to enable the at least two control branches in each of the control sub-circuits to be turned on sequentially, wherein while a clock control signal line inputs the turn-on control signal, other clock control signal lines input turn-off control signals, and the pull-down branches output the first power supply voltage to the corresponding output signal lines under the control of the turn-off control signals input from the clock control signal lines; in the second stage, a signal input from the input signal line is kept at a second level, and each of the output signal lines outputs a second-level signal, wherein a voltage at the second level is the same as the first power supply voltage.

DETAILED DESCRIPTION

Figure 1:
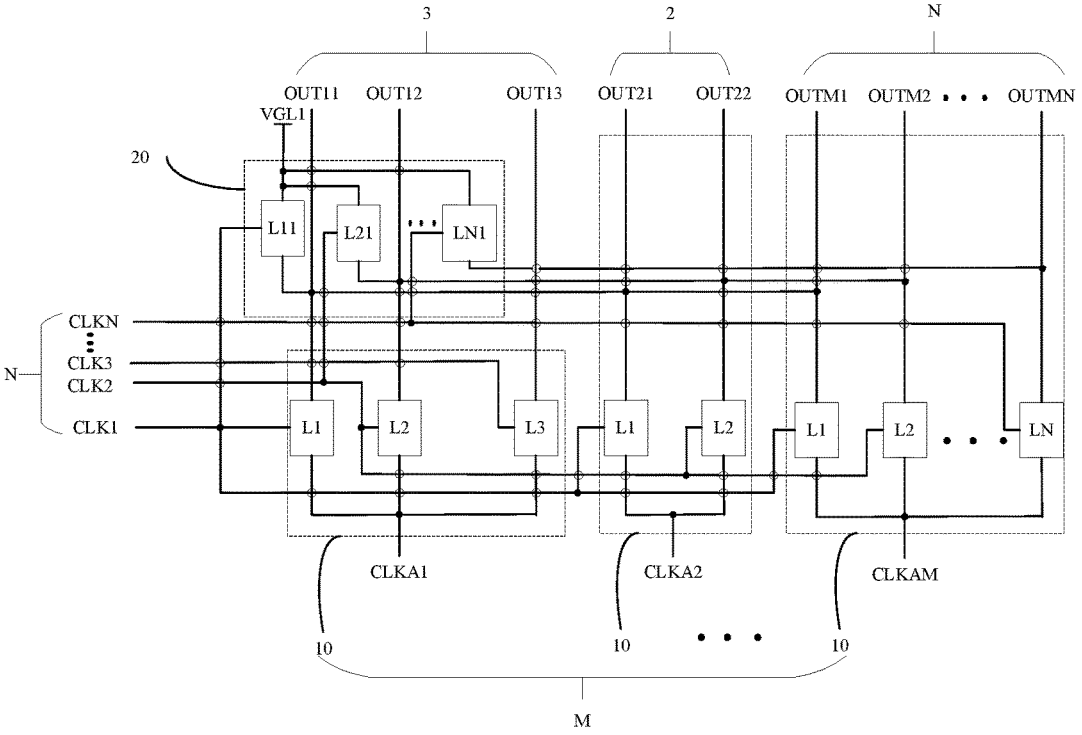
FIG. 1 is a schematic block diagram of a clock signal test circuit according to an embodiment of the present application.

Embodiments of the present application, examples of which are illustrated in the accompanying drawings, will be described in detail. Same or similar elements and elements with same or similar functions are denoted by same or similar reference numerals throughout the description. The embodiments described below with reference to the accompanying drawings are exemplary, and intended to explain the present disclosure, but should not be understood to limit the present application.

A clock signal test circuit, a control method thereof, a display panel and a test device according to embodiments of the present application will be described below with reference to the drawings.

In the related art, during a test for a gate drive circuit panel, an external compensation gate driver on array (GOA) needs, for example, three sets of clock signals to realize output of various gates respectively and output of a cascade relationship.

In the related art, in order to reduce loads of the clock signals, each set of clock signals needs about 10 clock signal channels. However, a problem with the related technology is that three sets of clock signals need 30 clock signal channels, plus low-voltage signal channels such as set, reset and power supply signal channels, i.e., 35-40 signal channels in total are needed. When there are too many signal channels, the number of signal channels will be difficult to be met by test settings. In addition, a large number of signal test pads will occupy a lot of peripheral layout space, which is not conducive to improvement of the utilization rate of glass.

For this end, the present application provides a clock signal testing circuit, in which a relatively small number of clock signal channels may be used to function as a relatively large number of clock signal channels, and the number of the clock signal channels of the gate drive circuit panel can further be reduced, for example, a function of 30 clock signals can be achieved by using 13 clock signals. In addition, investment for the test device can be reduced in the test stage, thereby decreasing the cost effectively and further optimizing the area of peripheral layout.

FIG. 1 is a schematic block diagram of a clock signal test circuit according to an embodiment of the present application. As shown in FIG. 1, the clock signal test circuit according to the embodiment of the present application includes N clock control signal lines CLK1-CLKN, M control sub-circuits 10 and a pull-down sub-circuit 20.

Each of the control sub-circuits 10 includes at least two control branches. Input terminals of the at least two control branches are all connected to the same input signal line. For example, input terminals of at least two control branches in the first control sub-circuit 10 are connected to the same input signal line CLKA1; input terminals of at least two control branches in the second control sub-circuit 10 are connected to the same input signal line CLKA2; likewise, input terminals of at least two control branches in the $M^{th}$ control sub-circuit 10 are connected to the same input signal line CLKAM. Control terminals of the at least two control branches are coupled to at least two of the N clock control signal lines respectively, and output terminals of the at least two control branches are connected to at least two output signal lines respectively. For example, assume that the first control sub-circuit 10 includes three control branches, as shown in FIG. 1, an output terminal of the first control branch L1 is connected to an output signal line OUT11, an output terminal of the second control branch L2 is connected to an output signal line OUT12, and an output terminal of the third control branch L3 is connected to an output signal line OUT13; the second control sub-circuit 10 includes two control branches, an output terminal of the first control branch L1 is connected to an output signal line OUT21, and an output terminal of the second control branch L2 is connected to an output signal line OUT22; the $M^{th}$ control sub-circuit 10 includes N control branches, an output terminal of the first control branch L1 is connected to an output signal line OUTM1, an output terminal of the second control branch L2 is connected to an output signal line OUTM2, an output terminal of the third control branch L3 is connected to an output signal line OUTM3, likewise, an output terminal of the $N^{th}$ control branch LN is connected to an output signal line OUTMN.

Each of the control branches is configured to output a signal input from an input signal line to a corresponding output signal line under the control of a signal input from the corresponding clock control signal line. For example, as shown in FIG. 1, the first control branch L1 in the first control sub-circuit 10 outputs a signal input from the input signal line CLKA1 to the corresponding output signal line OUT11 under the control of a signal input from the first clock control signal line CLK1; the second control branch L2 in the second control sub-circuit 10 outputs a signal input from the input signal line CLKA2 to the corresponding output signal line OUT22 under the control of a signal input from the second clock control signal line CLK2; the $N^{th}$ control branch LN in the $M^{th}$ control sub-circuit 10 outputs a signal input from the input signal line CLKAM to the corresponding output signal line OUTMN under the control of a signal input from the $N^{th}$ clock control signal line CLKN.

The number of control branches of at least one of the control sub-circuits 10 is N, both M and N being integers greater than 1. The pull-down sub-circuit 20 includes N pull-down branches L11-LN1, input terminals of the N pull-down branches L11-LN1 all receive a first power supply voltage VGL11, an output terminal of each of the N pull-down branches L11-LN1 is connected to an output signal line of at least one of the control sub-circuits 10. For example, as shown in FIG. 1, an output terminal of the first pull-down branch L11 is connected to the output signal line OUT11 of the first control sub-circuit 10, the output signal line OUT21 of the second control sub-circuit 10 and the output signal line OUTM1 of the $M^{th}$ control sub-circuit 10; an output terminal of the second pull-down branch L21 is connected to the output signal line OUT12 of the first control sub-circuit 10, the output signal line OUT22 of the second control sub-circuit 10 and the output signal line OUTM2 of the $M^{th}$ control sub-circuit 10; an output terminal of the $N^{th}$ pull-down branch LN1 is connected to the output signal line OUTMN of the $M^{th}$ control sub-circuit 10.

Control terminals of the N pull-down branches are connected to the N clock control signal lines CLK1-CLKN respectively, and each of the pull-down branches is configured to output the first power supply voltage VGL11 to a corresponding output signal line under the control of a signal input from a corresponding clock control signal line. For example, as shown in FIG. 1, the first pull-down branch L11 is used to output the first power supply voltage VGL11 to the corresponding output signal lines OUT11, OUT21 and OUTM1 under the control of a signal input from the corresponding clock control signal line CLK1; the second pull-down branch L21 is used to output the first power supply voltage VGL11 to the corresponding output signal lines OUT12, OUT22 and OUTM2 under the control of a signal input from the corresponding clock control signal line CLK2; the $N^{th}$ pull-down branch LN1 is used to output the first power supply voltage VGL11 to the corresponding output signal line OUTMN under the control of a signal input from the corresponding clock control signal line CLKN.

It should be noted that the first power supply voltage VGL11 is a low-level voltage, and the N pull-down branches L11-LN1 output the first power supply voltage VGL11, i.e., the low-level voltage, to the corresponding output signal lines under the control of the turn-off control signals input from the corresponding clock control signal lines CLK1-CLKN.

Figure 2:
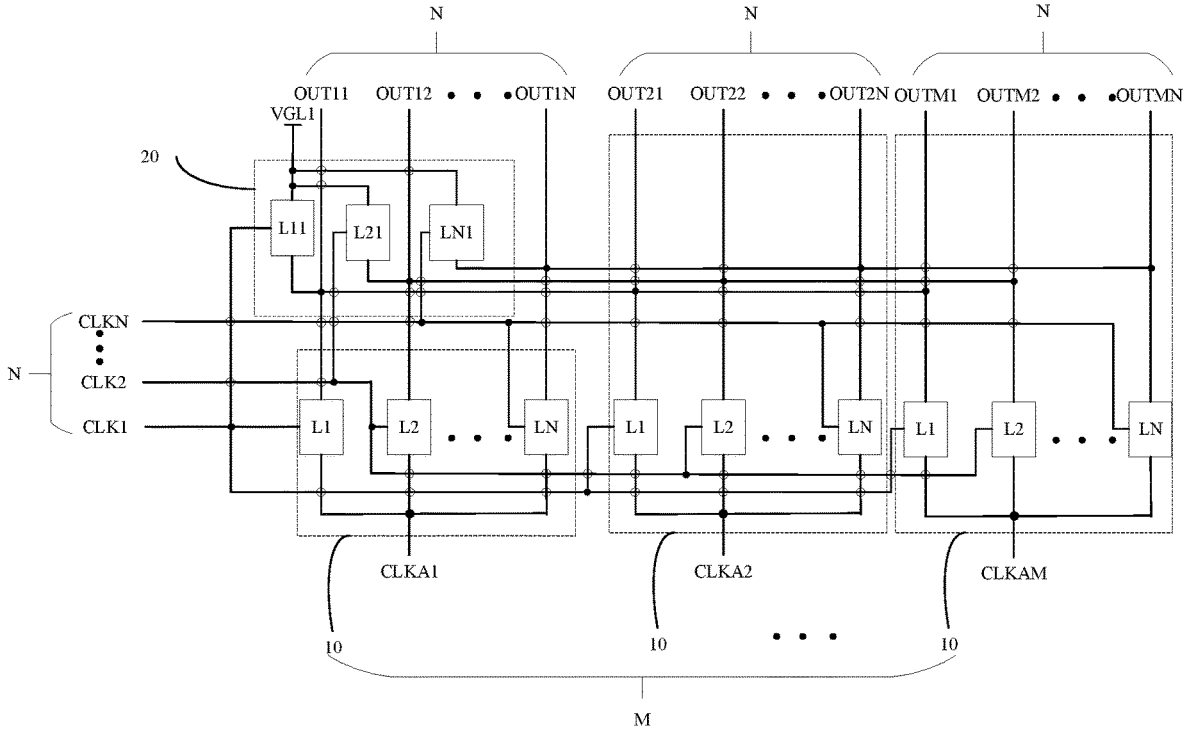
FIG. 2 is a schematic block diagram of a clock signal test circuit according to an embodiment of the present application.

According to an embodiment of the present application, as shown in FIG. 2, each of the control sub-circuits 10 includes N control branches L1-LN, and input terminals of the N control branches L1-LN are all connected to the same input signal line. For example, the input terminals of the N control branches L1-LN in the first control sub-circuit 10 are all connected to the same input signal line CLKA1; the input terminals of the N control branches L1-LN in the second control sub-circuit 10 are all connected to the same input signal line CLKA2; likewise, the input terminals of the N control branches L1-LN in the $M^{th}$ control sub-circuit 10 are all connected to the same input signal line CLKAM.

Control terminals of the N control branches L1-LN are coupled to the N clock control signal lines CLK1-CLKN respectively, output terminals of the N control branches L1-LN are connected to N output signal lines respectively. For example, as shown in FIG. 2, output terminals of the N control branches L1-LN of the first control sub-circuit 10 are connected to N output signal lines OUT11-OUT1N respectively; output terminals of the N control branches L1-LN of the second control sub-circuit 10 are connected to N output signal lines OUT21-OUT2N respectively; output terminals of the N control branches L1-LN of the $M^{th}$ control sub-circuit 10 are connected to N output signal lines OUTM1-OUTMN respectively.

The output terminal of each of the pull-down branches is connected to output signal lines of the M control sub-circuits. For example, as shown in FIG. 2, the output terminal of the first pull-down branch L11 is connected to the output signal line OUT11 of the first control sub-circuit 10, the output signal line OUT21 of the second control sub-circuit 10 to the output signal line OUTM1 of the $M^{th}$ control sub-circuit 10; the output terminal of the second pull-down branch L21 is connected to the output signal line OUT12 of the first control sub-circuit 10, the output signal line OUT22 of the second control sub-circuit 10 to the output signal line OUTM2 of the $M^{th}$ control sub-circuit 10; likewise, the output terminal of the $N^{th}$ pull-down branch LN1 is connected to the output signal line OUT1N of the first control sub-circuit 10, the output signal line OUT2N of the second control sub-circuit 10 to the output signal line OUTMN of the $M^{th}$ control sub-circuit 10.

Therefore, a relatively small number of clock signal channels may be used to function as a relatively large number of clock signal channels, for example, a function of (M×N) clock signal channels can be achieved by using (M+N) clock signal channels, further reducing the number of the clock signal channels of the gate drive circuit panel. In addition, investment for the test device can be reduced in the test stage, thereby decreasing the cost effectively and further optimizing the area of peripheral layout.

According to an embodiment of the present application, in the first stage, the signals input from the input signal lines CLKA1-CLKM are kept at a first level, and the N clock control signal lines CLK1-CLKN input turn-on control signals sequentially, to enable the at least two control branches in each of the control sub-circuits to be turned on sequentially, wherein while a clock control signal line inputs a turn-on control signal, other clock control signal lines input turn-off control signals, and the pull-down branches output the first power supply voltage VGL11 to the corresponding output signal lines under the control of the turn-off control signals input from the clock control signal lines; in the second stage, the signals input from the input signal lines CLKA1-CLKM are kept at a second level, and each of the output signal lines outputs a second-level signal, wherein a voltage at the second level is the same as the first power supply voltage VGL11.

The first level and the turn-on control signals may be at high level, and the second level and the turn-off control signals may be at low level.

It can be understood that, for example, as shown in FIG. 2, in the first stage, when the first clock control signal line CLK1 inputs a turn-on control signal, i.e., a high-level signal, a control branch, such as the first control branch L1, which is connected to the first clock control signal line CLK1, in each control sub-circuit 10 is turned on, and then a control branch, which is connected to the first clock control signal line CLK1, in each control sub-circuit 10 outputs a clock input signal input from an input signal line, i.e., a first-level signal, to a corresponding output signal line. In the meantime, the other clock control signal lines, such as the second clock control signal line CLK2 to the $N^{th}$ clock control signal line CLKN, input the turn-off control signals, i.e., low-level signals, and pull-down branches, such as the second pull-down branch L21 to the $N^{th}$ pull-down branch LN1, which are connected to the second clock control signal line CLK2 to the $N^{th}$ clock control signal line CLKN, in the pull-down sub-circuit 20 are turned on. Further, the first power supply voltage VGL11, i.e., a low-level voltage, is output to the output signal lines such as OUT12-OUT1N, OUT22-OUT2N and OUTM2-OUTMN which are connected to the second pull-down branch L21 to the $N^{th}$ pull-down branch LN1 respectively, so that the output signal lines such as OUT12-OUT1N, OUT22-OUT2N and OUTM2-OUTMN which are connected to the second pull-down branch L21 to the $N^{th}$ pull-down branch LN1 respectively in the pull-down sub-circuit 20 output low-level signals.

In the second stage, the signals input from the input signal lines CLKA1-CLKM are kept at the second level. In this stage, an output signal line in each control sub-circuit 10 outputs a second-level signal, i.e., a low-level signal, regardless of whether each clock control signal line inputs a turn-on control signal or a turn-off control signal. Specifically, when one clock control signal line inputs a turn-on control signal, a control branch connected to the clock control signal line is turned on, and then the turned-on control branch can output a second-level signal, i.e., a low-level signal, which is input from an input signal line, to a corresponding output signal line. When one clock control signal line inputs a turn-off control signal, a pull-down branch connected to the clock control signal line is turned on, and then the turned-on pull-down branch can output the first power supply voltage VGL11, i.e., a low-level signal, to a corresponding output signal line.

Specifically, according to an embodiment of the present application, an $i^{th}$ control branch Li in each of the control sub-circuits includes an $i^{th}$ transistor Mi, wherein a first electrode of the $i^{th}$ transistor Mi is connected to the input signal line, a second electrode of the $i^{th}$ transistor Mi is connected to an $i^{th}$ output signal line, and a control electrode of the $i^{th}$ transistor Mi is connected to an $i^{th}$ clock control signal line, wherein i is an integer greater than or equal to 1 and less than or equal to N.

Figure 3:
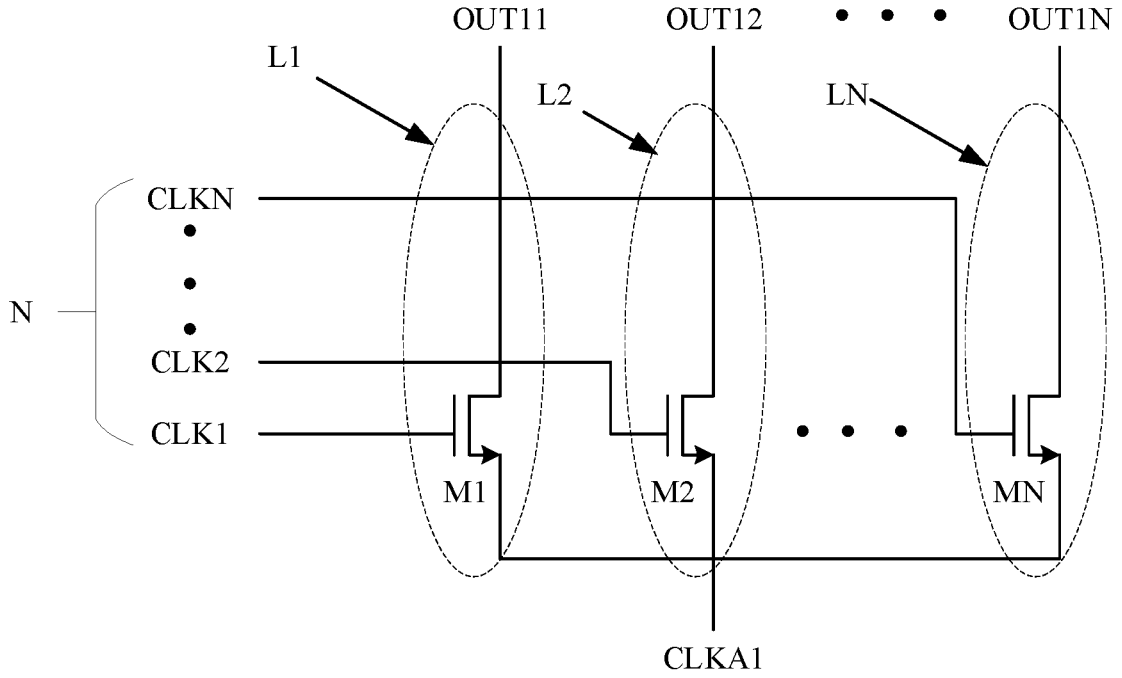
FIG. 3 is a schematic circuit diagram of a control sub-circuit of a clock signal test circuit according to an embodiment of the present application.
Figure 7:
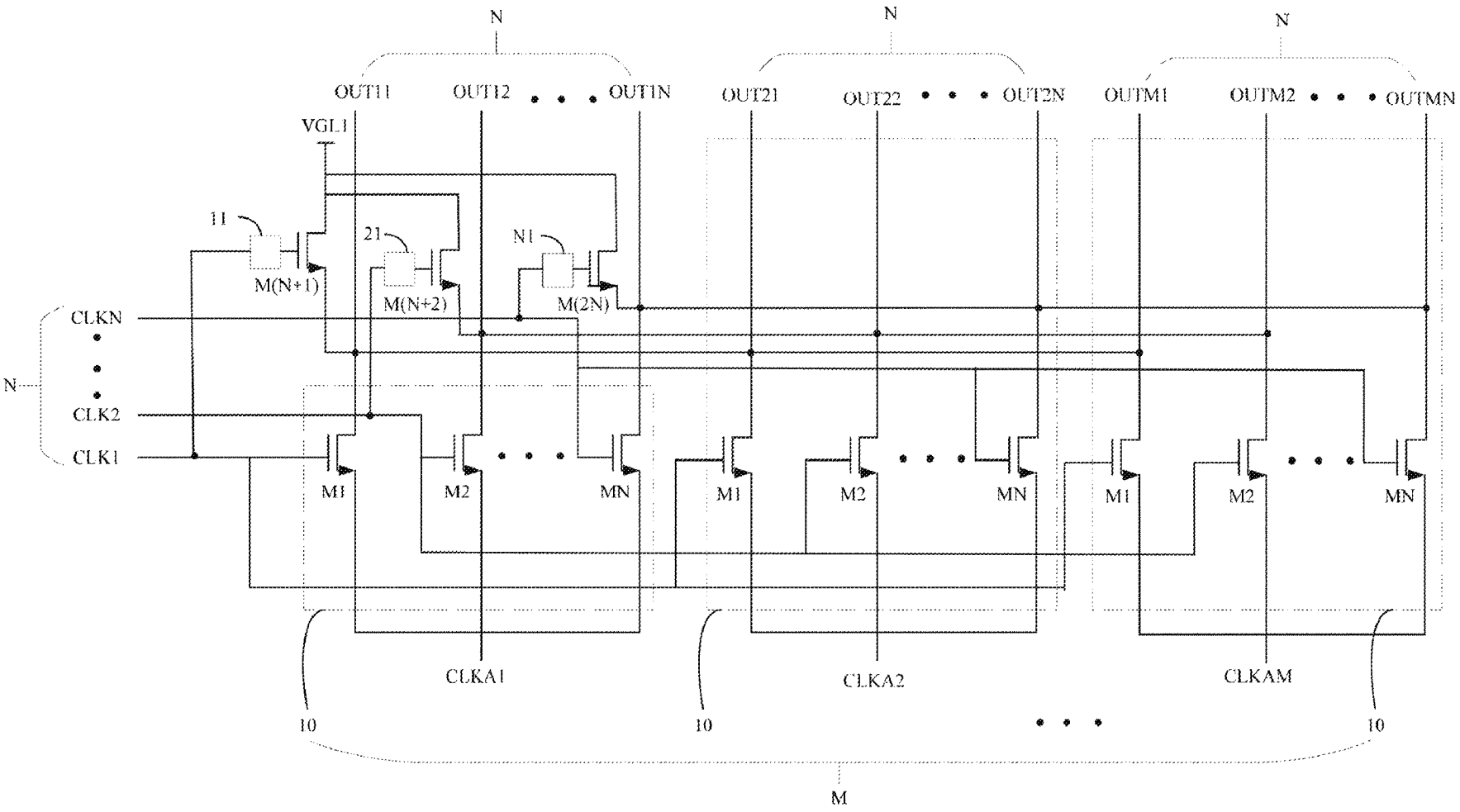
FIG. 7 is a schematic circuit diagram of a clock signal test circuit according to a specific embodiment of the present application.

As shown in FIGS. 3 and 7, each control sub-circuit 10 including N control branches L1-LN will be described as an example, the first control branch L1 in the first control sub-circuit 10 includes a first transistor M1, a first electrode of the first transistor M1 is connected to the input signal line CLKA1, a second electrode of the first transistor M1 is connected to the first output signal line OUT11, and a control electrode of the first transistor M1 is connected to the first clock control signal line CLK1; the second control branch L2 includes a second transistor M2, a first electrode of the second transistor M2 is connected to the input signal line CLKA1, a second electrode of the second transistor M2 is connected to the second output signal line OUT12, and a control electrode of the second transistor M2 is connected to the second clock control signal line CLK2; likewise, the $N^{th}$ control branch LN includes a $N^{th}$ transistor MN, a first electrode of the $N^{th}$ transistor MN is connected to the input signal line CLKA1, a second electrode of the $N^{th}$ transistor MN is connected to the $N^{th}$ output signal line OUT1N, and a control electrode of the $N^{th}$ transistor MN is connected to the $N^{th}$ clock control signal line CLKN.

The first control branch L1 in the second control sub-circuit 10 includes a first transistor M1, a first electrode of the first transistor M1 is connected to the input signal line CLKA2, a second electrode of the first transistor M1 is connected to the first output signal line OUT21, and a control electrode of the first transistor M1 is connected to the first clock control signal line CLK1; the second control branch L2 includes a second transistor M2, a first electrode of the second transistor M2 is connected to the input signal line CLKA2, a second electrode of the second transistor M2 is connected to the second output signal line OUT22, and a control electrode of the second transistor M2 is connected to the second clock control signal line CLK2; likewise, the $N^{th}$ control branch LN includes a $N^{th}$ transistor MN, a first electrode of the $N^{th}$ transistor MN is connected to the input signal line CLKA2, a second electrode of the $N^{th}$ transistor MN is connected to the $N^{th}$ output signal line OUT2N, and a control electrode of the $N^{th}$ transistor MN is connected to the $N^{th}$ clock control signal line CLKN.

Likewise, the first control branch L1 in the $M^{th}$ control sub-circuit 10 includes a first transistor M1, a first electrode of the first transistor M1 is connected to the input signal line CLKAM, a second electrode of the first transistor M1 is connected to the first output signal line OUTM1, and a control electrode of the first transistor M1 is connected to the first clock control signal line CLK1; the second control branch L2 includes a second transistor M2, a first electrode of the second transistor M2 is connected to the input signal line CLKAM, a second electrode of the second transistor M2 is connected to the second output signal line OUTM2, and a control electrode of the second transistor M2 is connected to the second clock control signal line CLK2; likewise, the $N^{th}$ control branch LN includes a $N^{th}$ transistor MN, a first electrode of the $N^{th}$ transistor MN is connected to the input signal line CLKAM, a second electrode of the $N^{th}$ transistor MN is connected to the $N^{th}$ output signal line OUTMN, and a control electrode of the $N^{th}$ transistor MN is connected to the $N^{th}$ clock control signal line CLKN.

It can be understood that the first control sub-circuit 10 will be described as an example, when one clock control signal line, such as the first clock control signal line CLK1, inputs a turn-on control signal, i.e., a high-level signal, the second clock control signal line CLK2 to the $N^{th}$ clock control signal line CLKN input turn-off control signals, i.e., low-level signals, at this time the first transistor M1 in the first control branch L1 in the control sub-circuit 10 is turned on, the corresponding second transistor M2 to $N^{th}$ transistor MN in other control branches, such as the second control branch L2 to the $N^{th}$ control branch LN, are all turned off, and then a clock input signal input from the input signal line CLKA1 is output to the corresponding first output signal line OUT11 through the first transistor M1.

Furthermore, according to an embodiment of the present application, an $i^{th}$ pull-down branch Li1 in the pull-down sub-circuit 20 includes an inverter, an input terminal of which is connected to the $i^{th}$ clock control signal line; and an $(N+i)^{th}$ transistor M(N+i), wherein a first electrode of the $(N+i)^{th}$ transistor M(N+i) is connected to a first power supply VGL1 providing the first power supply voltage VGL11, a second electrode of the $(N+i)^{th}$ transistor M(N+i) is connected to an output signal line of at least one of the control sub-circuits, and a control electrode of the $(N+i)^{th}$ transistor M(N+i) is connected to an output terminal of the inverter.

Figure 4:
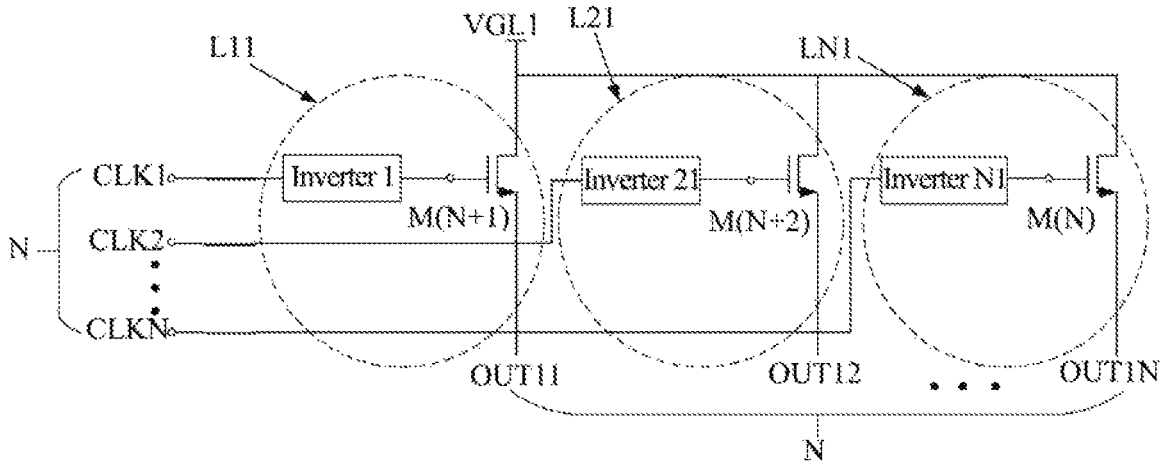
FIG. 4 is a schematic circuit diagram of a pull-up sub-circuit of a clock signal test circuit according to an embodiment of the present application.

As shown in FIGS. 4 and 7, each control sub-circuit 10 including N control branches L1-LN will be described as an example, a first pull-down branch L11 in the pull-down sub-circuit 20 includes an inverter 11, an input terminal of which is connected to the first clock control signal line CLK1; and an $(N+1)^{th}$ transistor M(N+1), wherein a first electrode of the $(N+1)^{th}$ transistor M(N+1) is connected to the first power supply VGL1 providing the first power supply voltage VGL11, a second electrode of the $(N+1)^{th}$ transistor M(N+1) is connected to the first output signal line OUT11 in the first control sub-circuit 10, the first output signal line OUT21 in the second control sub-circuit 10 and the first output signal line OUTM1 in the $M^{th}$ control sub-circuit 10, and a control electrode of the $(N+1)^{th}$ transistor M(N+1) is connected to an output terminal of the inverter 11.

A second pull-down branch L21 in the pull-down sub-circuit 20 includes an inverter 21, an input terminal of which is connected to the second clock control signal line CLK2; and an $(N+2)^{th}$ transistor M(N+2), wherein a first electrode of the $(N+2)^{th}$ transistor M(N+2) is connected to the first power supply VGL1 providing the first power supply voltage VGL11, a second electrode of the $(N+2)^{th}$ transistor M(N+2) is connected to the second output signal line OUT12 in the first control sub-circuit 10, the second output signal line OUT22 in the second control sub-circuit 10 and the second output signal line OUTM2 in the $M^{th}$ control sub-circuit 10, and a control electrode of the $(N+2)^{th}$ transistor M(N+2) is connected to an output terminal of the inverter 21.

Likewise, a $N^{th}$ pull-down branch LN1 in the pull-down sub-circuit 20 includes an inverter N1, an input terminal of which is connected to the $N^{th}$ clock control signal line CLKN; and an $(2N)^{th}$ transistor M(2N), wherein a first electrode of the $(2N)^{th}$ transistor M(2N) is connected to the first power supply VGL1 providing the first power supply voltage VGL11, a second electrode of the $(2N)^{th}$ transistor M(2N) is connected to the $N^{th}$ output signal line OUT1N in the first control sub-circuit 10, the $N^{th}$ output signal line OUT2N in the second control sub-circuit 10 and the $N^{th}$ output signal line OUTMM in the $M^{th}$ control sub-circuit 10, and a control electrode of the $(2N)^{th}$ transistor M(2N) is connected to an output terminal of the inverter N1.

It can be understood that the first control sub-circuit 10 will be described as an example, when one clock control signal line, such as the first clock control signal line CLK1, inputs a turn-on control signal, i.e., a high-level signal, the second clock control signal line CLK2 to the $N^{th}$ clock control signal line CLKN input turn-off control signals, i.e., low-level signals, at this time the first transistor M1 in the first control branch L1 in the control sub-circuit 10 is turned on, and the $(N+1)^{th}$ transistor M(N+1) in the first pull-down branch L11 of the pull-down sub-circuit 20 is turned off due to the function of the inverter 11 connected to the first clock control signal line CLK1, and then a clock input signal input from the input signal line CLKA1 is output to the first output signal line OUT11 of the first control sub-circuit 10. The corresponding second transistor M2 to Nth transistor MN in other control branches, such as the second control branch L2 to the $N^{th}$ control branch LN, in the first control sub-circuit are all turned off. Similarly, transistors in the second pull-down branch L21 to the $N^{th}$ pull-down branch LN1 in the pull-down sub-circuit 20 are all turned on due to the function of the inverters 21-N1 connected to the second clock control signal line CLK2 to the $N^{th}$ clock control signal line CLKN respectively. Furthermore, the second output signal line OUT12 to the $N^{th}$ output signal line OUT1N of the first control sub-circuit 10 can be pulled down to the first power supply voltage VGL11, that is, the low-level voltage.

Therefore, negative voltage outputs from the first output signal line to the $N^{th}$ output signal line in each control sub-circuit 10 can be realized by the inverter.

Figure 5:
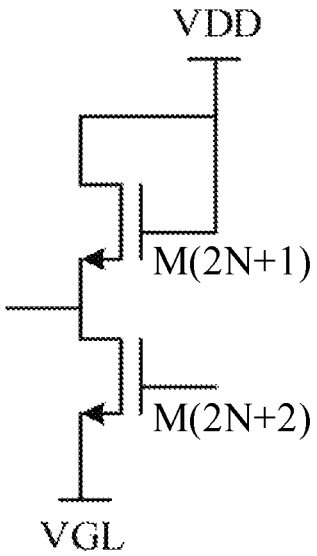
FIG. 5 is a schematic circuit diagram of an inverter of a clock signal test circuit according to an embodiment of the present application.

Specifically, according to an embodiment of the present application, as shown in FIG. 5, the inverter includes a $(2N+1)^{th}$ transistor M(2N+1) and a $(2N+2)^{th}$ transistor M(2N+2). Herein, a first electrode and a control electrode of the $(2N+1)^{th}$ transistor M(2N+1) are connected to a second power supply VDD; a control electrode of the $(2N+2)^{th}$ transistor M(2N+2) serves as the input terminal of the inverter, a first electrode of the $(2N+2)^{th}$ transistor M(2N+2) is connected to a second electrode of the $(2N+1)^{th}$ transistor M(2N+1) and then serves as the output terminal of the inverter, and a second electrode of the $(2N+2)^{th}$ transistor M(2N+2) is connected to a third power supply VGL.

It should be noted that the voltage of the second power supply VDD may be a high-level voltage, and the voltage of the third power supply VGL may be a low-level voltage.

It can be understood that when one clock control signal line, such as the first clock control signal line CLK1, inputs a turn-on control signal, i.e., a high-level signal, the second clock control signal line CLK2 to the $N^{th}$ clock control signal line CLKN input turn-off control signals, i.e., low-level signals, at this time, the input terminal of the inverter 11 connected to the first clock control signal line CLK1 inputs a high-level signal, and then the control electrode of the $(2N+2)^{th}$ transistor M(2N+2) in the inverter 11 is connected to a high-level voltage, and the $(2N+2)^{th}$ transistor M(2N+2) is turned on, so that the output terminal of the inverter 11 outputs a low-level voltage, that is, the voltage of the third power supply VGL.

At the same time, the input terminals of the inverters 21-N1 connected to the second clock control signal line CLK2 to the $N^{th}$ clock control signal line CLKN input the low-level signals, and then the control electrodes of the $(2N+2)^{th}$ transistors M(2N+2) in the inverters 21-N1 are connected to a low-level voltage, the $(2N+2)^{th}$ transistors M(2N+2) are turned off, the $(2N+1)^{th}$ transistors M(2N+1) are turned on, so that the output terminals OUT0 of the inverters 21-N1 output a high-level voltage, that is, the voltage of the second power supply VDD.

Therefore, the inverter can realize the phase inversion. Specifically, when the input terminal of the inverter inputs a high-level signal, its output terminal outputs a low-level signal, and when the input terminal of the inverter inputs a low-level signal, its output terminal outputs a high-level signal.

Figure 6:
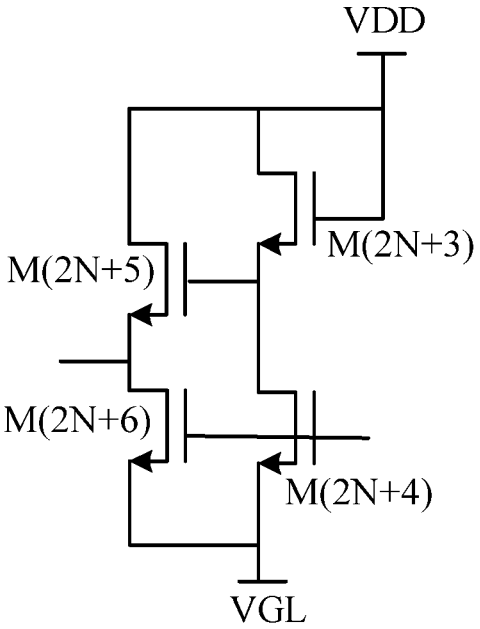
FIG. 6 is a schematic circuit diagram of an inverter of a clock signal test circuit according to another embodiment of the present application.

According to another embodiment of the present application, as shown in FIG. 6, the inverter includes a $(2N+3)^{th}$ transistor M(2N+3), a $(2N+4)^{th}$ transistor M(2N+4), a $(2N+5)^{th}$ transistor M(2N+5), and a $(2N+6)^{th}$ transistor M(2N+6). Herein, a first electrode and a control electrode of the $(2N+3)^{th}$ transistor M(2N+3) are connected to the second power supply VDD; a first electrode of the $(2N+4)^{th}$ transistor M(2N+4) is connected to a second electrode of the $(2N+3)^{th}$ transistor M(2N+3), and a second electrode of the $(2N+4)^{th}$ transistor M(2N+4) is connected to the third power supply VGL; a first electrode of the $(2N+5)^{th}$ transistor M(2N+5) is connected to the second power supply VDD, and a control electrode of the $(2N+5)^{th}$ transistor M(2N+5) is connected to the second electrode of the $(2N+3)^{th}$ transistor M(2N+3); a control electrode of the $(2N+6)^{th}$ transistor M(2N+6) is connected to a control electrode of the $(2N+4)^{th}$ transistor M(2N+4) and then serves as the input terminal of the inverter, a first electrode of the $(2N+6)^{th}$ transistor M(2N+6) is connected to a second electrode of the $(2N+5)^{th}$ transistor M(2N+5) and then serves as the output terminal of the inverter, and a second electrode of the $(2N+6)^{th}$ transistor M(2N+6) is connected to the third power supply VGL.

It can be understood that when one clock control signal line, such as the first clock control signal line CLK1, inputs a turn-on control signal, i.e., a high-level signal, the second clock control signal line CLK2 to the $N^{th}$ clock control signal line CLKN input turn-off control signals, i.e., low-level signals, at this time, the input terminal of the inverter 11 connected to the first clock control signal line CLK1 inputs a high-level signal, and then the control electrodes of the $(2N+4)^{th}$ transistor M(2N+4) and the $(2N+6)^{th}$ transistor M(2N+6) in the inverter 11 are connected to a high-level voltage, and the $(2N+4)^{th}$ transistor M(2N+4) and the $(2N+6)^{th}$ transistor M(2N+6) are turned on, so that the output terminal of the inverter 11 outputs a low-level voltage, that is, the voltage of the third power supply VGL.

At the same time, the input terminals of the inverters 21-N1 connected to the second clock control signal line CLK2 to the $N^{th}$ clock control signal line CLKN input the low-level signals, and then the control electrodes of the $(2N+4)^{th}$ transistor M(2N+4) and the $(2N+6)^{th}$ transistor M(2N+6) in the inverters 21-N1 are connected to a low-level voltage, the $(2N+4)^{th}$ transistor M(2N+4) and the $(2N+6)^{th}$ transistor M(2N+6) are turned off, the $(2N+3)^{th}$ transistor M(2N+3) and the $(2N+5)^{th}$ transistor M(2N+5) are turned off, so that the output terminals OUT0 of the inverters 21-N1 output a high-level voltage, that is, the voltage of the second power supply VDD.

Therefore, the inverter can realize the phase inversion. Specifically, when the input terminal of the inverter inputs a high-level signal, its output terminal outputs a low-level signal, and when the input terminal of the inverter inputs a low-level signal, its output terminal outputs a high-level signal.

Figure 8:
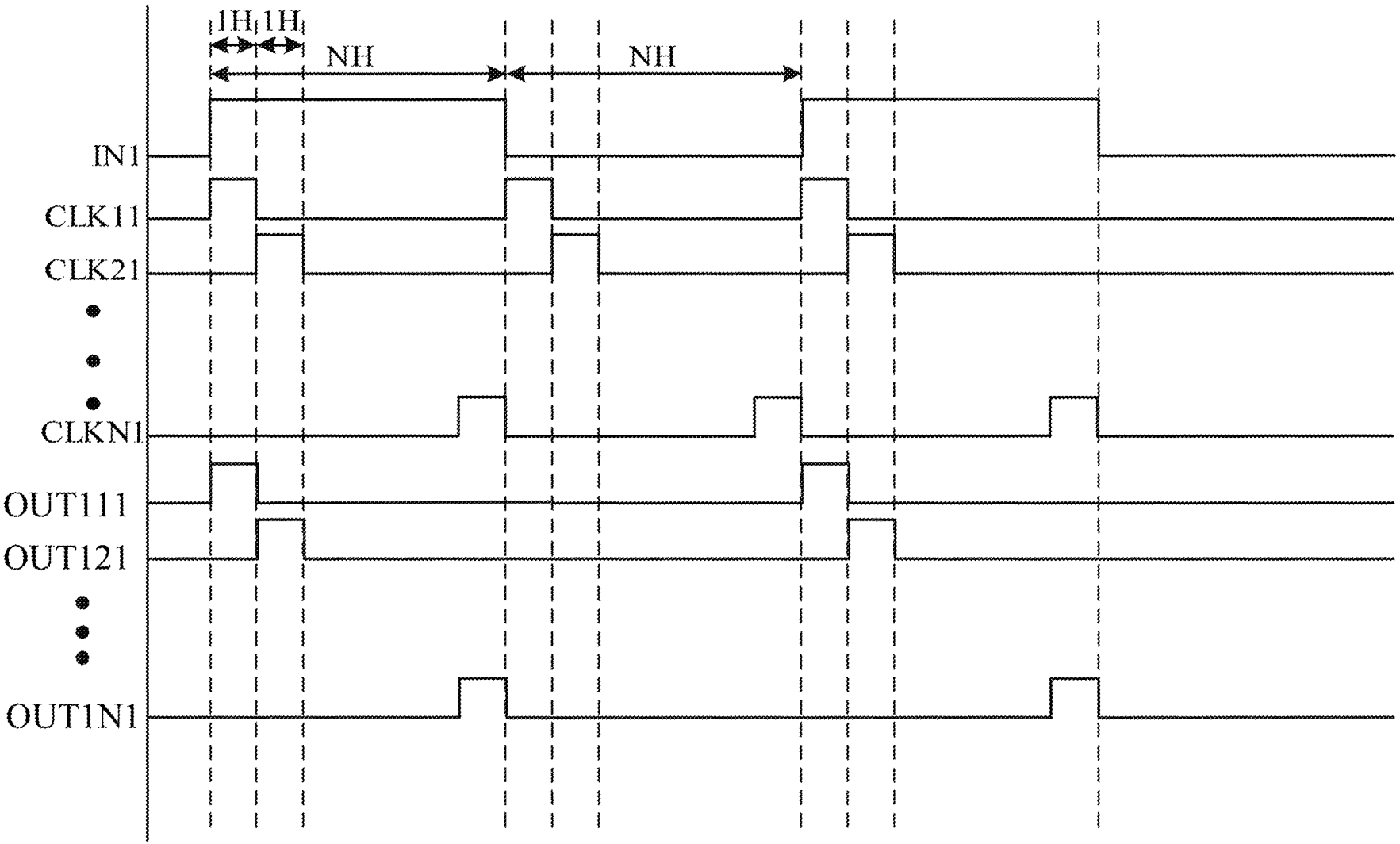
FIG. 8 is a schematic timing diagram of a clock signal test circuit according to an embodiment of the present application.

The operating principle of an embodiment of FIG. 7 will be further described with reference to a timing diagram of FIG. 8, wherein each control sub-circuit in the embodiment of FIG. 7 includes N control branches L1-LN. It can be understood that the operating principles of M control sub-circuits 10 are all the same, so a control sub-circuit 10 such as the first control sub-circuit 10 will be specifically described as an example. IN1 may be a clock input signal input from the input signal line CLKA1 of the first control sub-circuit 10, CLK11, CLK21 CLKN1 may be the input signals of the N clock control signal lines CLK1-CLKN respectively, OUT111, OUT121 . . . OUT1N1 may be output signals of the first output signal line OUT11 to the $N^{th}$ output signal line OUT1N of the first control sub-circuit 10 respectively, 1H may be the length of time during which each of the N clock control signal lines CLK1-CLKN inputs a turn-on control signal, and the length of time during which each input signal line inputs a high-level signal or a low-level signal may be N times the length of time during which each of the N clock control signal lines CLK1-CLKN inputs a turn-on control signal, that is, NH.

It can be understood that while a clock input signal input from the input signal line CLKA1 is a high-level signal, when one clock control signal line, such as the first clock control signal line CLK1, inputs a turn-on control signal, i.e., a high-level signal, the second clock control signal line CLK2 to the $N^{th}$ clock control signal line CLKN input turn-off control signals, i.e., low-level signals, at this time the first transistor M1 in the first control branch L1 in the control sub-circuit 10 is turned on, the corresponding second transistor M2 to $N^{th}$ transistor MN in other control branches, such as the second control branch L2 to the $N^{th}$ control branch LN, are all turned off due to the function of the inverter 11 connected to the first clock control signal line CLK1, the control electrode of the $(N+1)^{th}$ transistor M(N+1) in the first pull-down branch L11 in the pull-down sub-circuit 20 is connected to a low-level signal, and the $(N+1)^{th}$ transistor M(N+1) is turned off. Further, a clock input signal, i.e., a high-level signal input from the input signal line CLKA1 is output to the first output signal line OUT11 of the first control sub-circuit 10. The control electrodes of the corresponding $(N+2)^{th}$ transistor M(N+2) to $(2N)^{th}$ transistor M(2N) in the second control branch L21 to the $N^{th}$ control branch LN1 in the pull-down sub-circuit 20 are connected to a high-level signal due to the function of the inverters 21-N1 connected to the second clock control signal CLK2 to the $N^{th}$ clock control signal CLKN respectively, the corresponding $(N+2)^{th}$ transistor M(N+2) to $(2N)^{th}$ transistor M(2N) in the second control branch L21 to the $N^{th}$ control branch LN1 are all turned on. Furthermore, the second output signal line OUT12 to the $N^{th}$ output signal line OUT1N in the first control sub-circuit 10 are pulled down to the first power supply voltage VGL11, that is, the low-level voltage. Then, like the first clock control signal line CLK1 inputting a turn-on control signal, the second clock control signal line CLK2 to the $N^{th}$ clock control signal line CLKN input sequentially turn-on control signals, i.e., high-level signals, and then the second output signal line OUT12 to the $N^{th}$ output signal line OUT1N in the first control sub-circuit 10 output sequentially high-level signals.

While a clock input signal input from the input signal line CLKA1 is a low-level signal, when one clock control signal line, such as the first clock control signal line CLK1, inputs a turn-on control signal, i.e., a high-level signal, the second clock control signal line CLK2 to the $N^{th}$ clock control signal line CLKN input turn-off control signals, i.e., low-level signals, at this time the first transistor M1 in the first control branch L1 in the control sub-circuit 10 is turned on, the corresponding second transistor M2 to $N^{th}$ transistor MN in other control branches, such as the second control branch L2 to the $N^{th}$ control branch LN, are all turned off due to the function of the inverter 11 connected to the first clock control signal line CLK1, the control electrode of the $(N+1)^{th}$ transistor M(N+1) in the first pull-down branch L11 in the pull-down sub-circuit 20 is connected to a low-level signal, and the $(N+1)^{th}$ transistor M(N+1) is turned off. Further, a clock input signal, i.e., a low-level signal input from the input signal line CLKA1 is output to the first output signal line OUT11 of the first control sub-circuit 10. The control electrodes of the corresponding $(N+2)^{th}$ transistor M(N+2) to $(2N)^{th}$ transistor M(2N) in the second control branch L21 to the $N^{th}$ control branch LN1 in the pull-down sub-circuit 20 are connected to a high-level signal due to the function of the inverters 21-N1 connected to the second clock control signal CLK2 to the $N^{th}$ clock control signal CLKN respectively, the corresponding $(N+2)^{th}$ transistor M(N+2) to $(2N)^{th}$ transistor M(2N) in the second control branch L21 to the $N^{th}$ control branch LN1 are all turned on. Furthermore, the second output signal line OUT12 to the $N^{th}$ output signal line OUT1N in the first control sub-circuit 10 are pulled down to the first power supply voltage VGL11, that is, the low-level voltage. Then, like the first clock control signal line CLK1 inputting a turn-on control signal, the second clock control signal line CLK2 to the $N^{th}$ clock control signal line CLKN input sequentially turn-on control signals, i.e., high-level signals, and then the second output signal line OUT12 to the $N^{th}$ output signal line OUT1N in the first control sub-circuit 10 output sequentially low-level signals.

That is, while a clock input signal input from the input signal line CLKA1 is a low-level signal, the first output signal line OUT11 to the $N^{th}$ output signal line OUT1N of the first control sub-circuit 10 output low level signals, regardless of whether the N clock control signal lines CLK1-CLKN input turn-on control signals or turn-off control signals.

Figure 9:
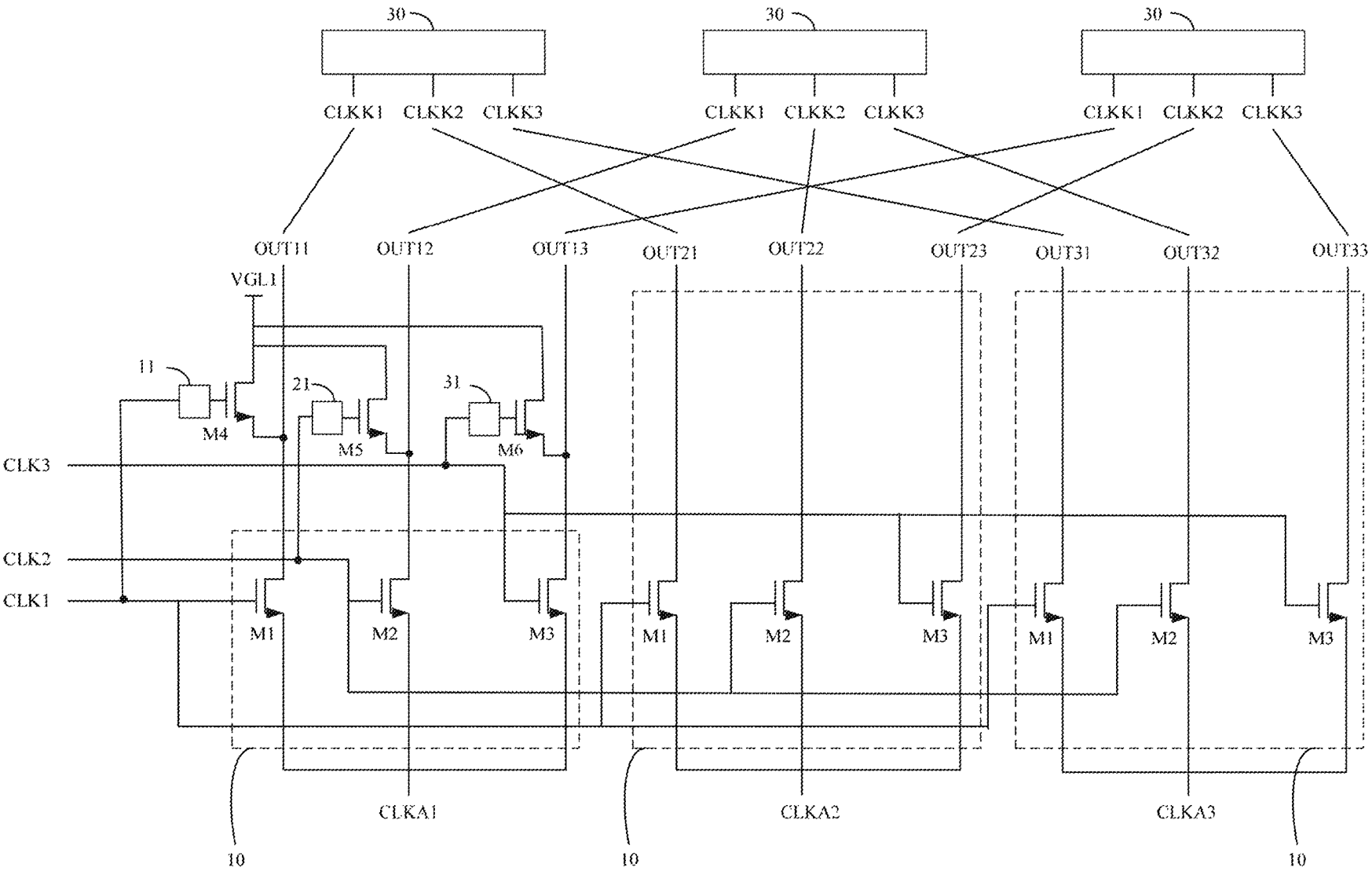
FIG. 9 is a schematic circuit diagram of a clock signal test circuit according to another specific embodiment of the present application.
Figure 10:
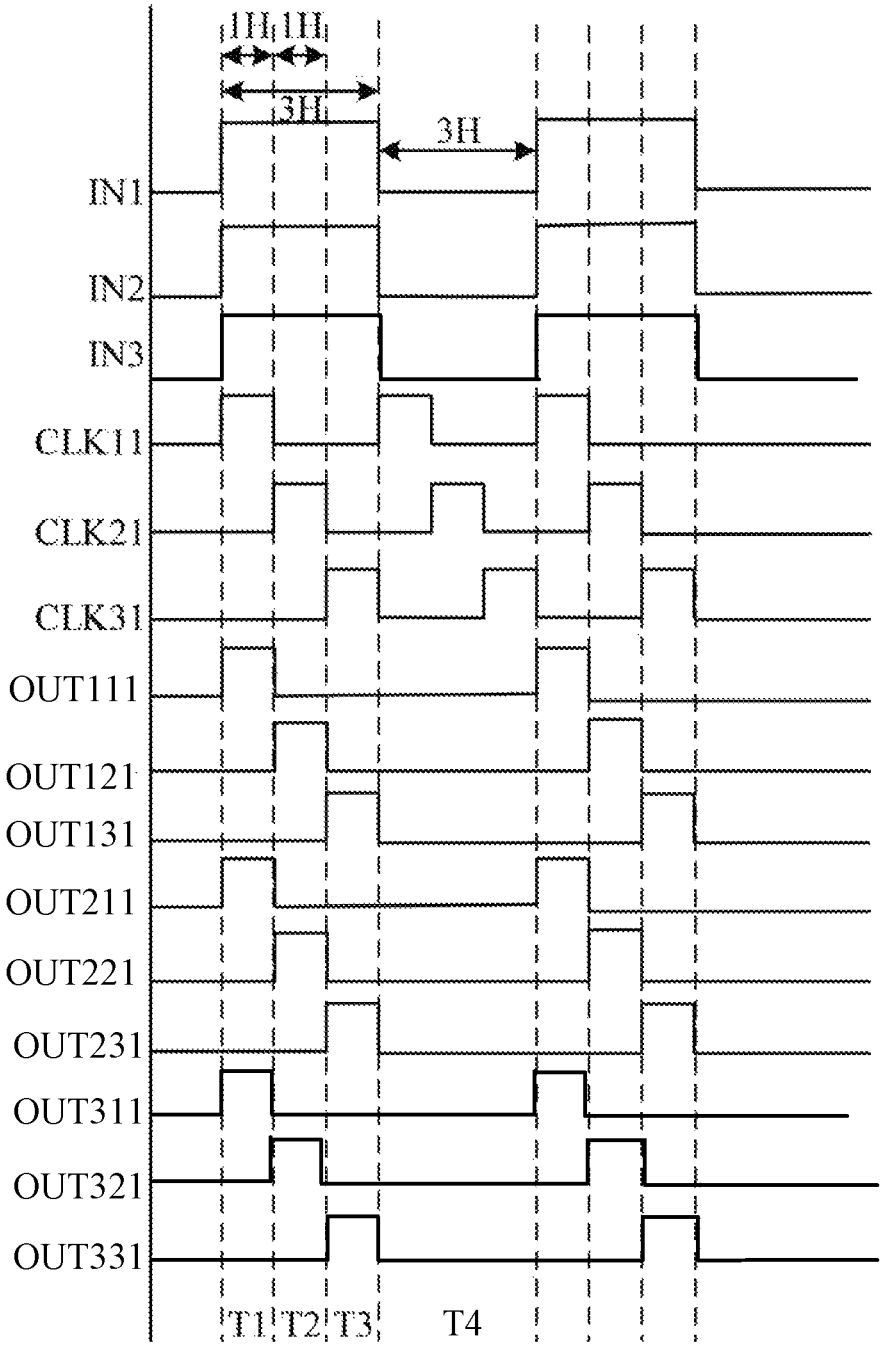
FIG. 10 is a schematic timing diagram of a clock signal test circuit according to another embodiment of the present application.

Specifically, as an example, as shown in FIGS. 9-10, M=N=3, that is, the clock signal test circuit in this embodiment of the present application including three control sub-circuits 10 and each control sub-circuit 10 including three control branches will be described as an example, the operating principle of the clock signal test circuit in this embodiment of the present application will be explained. IN1, IN2 and IN3 may be the clock input signals input from the input signal lines of the first control sub-circuit 10 to the third control sub-circuit 10 respectively, CLK11, CLK21 and CLK31 may be the input signals of N=3 clock control signal lines, namely, the first clock control signal line CLK1 to the third clock control signal line CLK3 respectively, OUT111, OUT121 and OUT131 may be the output signals of the first output signal line OUT11, the second output signal line OUT12 and the third output signal line OUT13 of the first control sub-circuit 10 respectively, OUT211, OUT221 and OUT231 may be the output signals of the first output signal line OUT21, the second output signal line OUT22 and the third output signal line OUT23 of the second control sub-circuit 10 respectively; OUT311, OUT321 and OUT331 may be the output signals of the first output signal line OUT31, the second output signal line OUT32 and the third output signal line OUT33 of the third control sub-circuit 10 respectively, 1H may be the length of time during which each of the three clock control signal lines CLK1-CLK3 inputs the turn-on control signal, and the length of time during which each input signal line inputs a high-level signal or a low-level signal may be N times the length of time during which each of the 3 clock control signal lines CLK1-CLK3 inputs a turn-on control signal, that is, 3H.

When the clock input signals input from the input signal lines are at the high level, the first clock control signal line CLK1 to the third clock control signal line CLK3 input sequentially the turn-on control signals, that is, the high-level signals, at this time the high-level signals are output sequentially from the first output signal line to the third output signal line of the control sub-circuit 10.

It can be understood that, as shown in FIGS. 9-10, in the T1 stage, the clock input signals IN1', IN2 and IN3 input from the input signal line CLKA1 of the first control sub-circuit 10, the input signal line CLKA2 of the second control sub-circuit 10 and the input signal line CLKA3 of the third control sub-circuit 10 are at the high level, and when the first clock control signal line CLK1 inputs a turn-on control signal, i.e., a high-level signal, the second clock control signal line CLK2 and the third clock control signal line CLK3 input turn-off control signals, i.e., low-level signals, and the first transistors M1 in the first control branches L1 in the first control sub-circuit 10, the second control sub-circuit 10 and the third control sub-circuit 10 are turned on, thus the clock input signals, i.e., high-level signals, input from the input signal line CLKA1 of the first control sub-circuit 10, the input signal line CLKA2 of the second control sub-circuit 10, and the input signal line CLKA3 of the third control sub-circuit 10 are output to the corresponding first output signal lines respectively, i.e., the output signal OUT111 of the first output signal line OUT11 of the first control sub-circuit 10 is at the high level, the output signal OUT211 of the first output signal line OUT21 of the second control sub-circuit 10 is at the high level, and the output signal OUT311 of the first output signal line OUT31 of the third control sub-circuit 10 is at the high level. Similarly, in the following T2 and T3 stages, the second clock control signal CLK2 and the third clock control signal CLK3 input sequentially turn-on control signals, i.e., high-level signals, and then the second output signal line OUT12 of the first control sub-circuit 10, the second output signal line OUT22 of the second control sub-circuit 10 and the second output signal line OUT32 of the third control sub-circuit 10 output high-level signals sequentially.

When clock input signals input from input signal lines are at a high level, three clock control signal lines input turn-on control signals sequentially. For example, when the first clock control signal line CLK1 inputs a turn-on control signal, i.e., a high-level signal, the second clock control signal line CLK2 to the third clock control signal line CLK3 input turn-off control signals, i.e., low-level signals, at this time the second output signal line and the third output signal line of the control sub-circuit 10 output low-level signals under the function of the inverter.

It can be understood that, as shown in FIGS. 9-10, in the T1 stage, the clock input signals IN1', IN2 and IN3 input from the input signal line CLKA1 of the first control sub-circuit 10, the input signal line CLKA2 of the second control sub-circuit 10 and the input signal line CLKA3 of the third control sub-circuit 10 are at the high level, and when the first clock control signal line CLK1 inputs a turn-on control signal, i.e., a high-level signal, the second clock control signal line CLK2 and the third clock control signal line CLK3 input turn-off control signals, i.e., low-level signals, and the corresponding second transistors M2 and third transistors M3 in the second control branches L2 and the third control branches L3 in the first control sub-circuit 10, the second control sub-circuit 10 and the third control sub-circuit 10 are turned off, at this time due to the function of the inverters 21 and 31 connected to the second clock control signal line CLK2 and the third clock control signal line CLK3 respectively, control electrodes of the fifth transistor M5 in the second pull-down branch L21 and the sixth transistor M6 in the third pull-down branch L31 in the pull-down sub-circuit 20 are connected to a high-level signal, and the fifth transistor M5 in the second pull-down branch L21 and the sixth transistor M6 in the third pull-down branch L31 are turned on. Furthermore, the second and third output signal lines OUT12 and OUT13 in the first control sub-circuit 10, the second and third output signal lines OUT22 and OUT23 in the second control sub-circuit 10, and the second and third output signal lines OUT32 and OUT33 in the third control sub-circuit 10 are pulled down to the first power supply voltage VGL11, that is, the low-level voltage. Similarly, in the following stage T2, if the second clock control signal line CLK2 inputs a turn-on control signal, i.e., a high-level signal, and the first clock control signal line CLK1 and the third clock control signal line CLK3 input turn-off control signals, i.e., low-level signals, then the first output signal lines and the third output signal lines of the first, second and third control sub-circuits 10 output low-level signals. In the T3 stage, if the third clock control signal line CLK3 inputs a turn-on control signal, i.e., a high-level signal, and the first and second clock control signal lines CLK1 and CLK2 input turn-off control signals, i.e., low-level signals, then the first and second output signal lines of the first, second and third control sub-circuits 10 output low-level signals.

When the clock input signals input from the input signal lines are at the low level, the first clock control signal line CLK1 to the third clock control signal lines CLK3 input sequentially the turn-on control signals, that is, high-level signals, at this time the first output signal line to the third output signal line of the control sub-circuit 10 output sequentially the low-level signals.

It can be understood that, as shown in FIGS. 9-10, in the T4 stage, the clock input signals input from the input signal lines of the three control sub-circuits 10 are all at the low level, and when the first clock control signal line CLK1 inputs a turn-on control signal, i.e., a high-level signal, the second clock control signal line CLK2 and the third clock control signal line CLK3 input turn-off control signals, i.e., low level-signals, the first transistors M1 in the first control branches L1 of the three control sub-circuits 10 are all turned on, thus the clock input signals, i.e., the low-level signals, input from the input signal lines of the three control sub-circuits 10 are output to the corresponding first output signal lines, i.e., the output signal OUT111 of the first output signal line OUT11 of the first control sub-circuit 10 is at the low level, the output signal OUT211 of the first output signal line OUT21 of the second control sub-circuit 10 is at the low level, and the output signal OUT311 of the first output signal line OUT31 of the second control sub-circuit 10 is at the low level. Similarly, when the second clock control signal line CLK2 and the third clock control signal line CLK3 input sequentially turn-on control signals, i.e., high-level signals, the second output signal lines and the third output signal lines of the three control sub-circuits 10 output sequentially low-level signals, that is, the output signal OUT121 of the second output signal line OUT12 and the output signal OUT131 of the third output signal line OUT13 of the first control sub-circuit 10 output sequentially the low-level signals, the output signal OUT221 of the second output signal line OUT22 and the output signals OUT231 of the third output signal line OUT23 of the second control sub-circuit 10 output sequentially the low-level signals, and the output signal OUT321 of the second output signal line OUT32 and the output signal OUT331 of the third output signal line OUT33 of the third control sub-circuit 10 output sequentially the low-level signals.

When the clock input signals input from the input signal lines are at the low level, the three clock control signal lines input the turn-on control signals sequentially. For example, when the first clock control signal line CLK1 inputs a turn-on control signal, i.e., a high-level signal, the second clock control signal line CLK2 to the third clock control signal line CLK3 input turn-off control signals, i.e., low-level signals, at this time the second output signal line and the third output signal line input low-level signals under the function of the inverter.

It can be understood that, as shown in FIGS. 9-10, in the T4 stage, the clock input signals input from the input signal lines of the three control sub-circuits 10 are all at the low level, and when the first clock control signal line CLK1 inputs a turn-on control signal, i.e., a high-level signal, the second clock control signal line CLK2 and the third clock control signal line CLK3 input turn-off control signals, i.e., low level-signals, the corresponding second transistors M2 and third transistors M3 in the second control branches L2 and the third control branches L3 of the three control sub-circuits 10 are all turned on, at this time due to the function of the inverters 21 and 31 connected to the second clock control signal line CLK2 and the third clock control signal line CLK3 respectively, control electrodes of the fifth transistor M5 in the second pull-down branch L21 and the sixth transistor M6 in the third pull-down branch L31 in the pull-down sub-circuit 20 are connected to a high-level signal, and the fifth transistor M5 in the second pull-down branch L21 and the sixth transistor M6 in the third pull-down branch L31 are turned on. Furthermore, the second and third output signal lines in three control sub-circuits 10 are pulled down to the first power supply voltage VGL11, that is, the low-level voltage, that is, the output signal OUT121 of the second output signal line OUT12 and the output signal OUT131 of the third output signal line OUT13 of the first control sub-circuit 10 are all at the low level, the output signal OUT221 of the second output signal line OUT22 and the output signal OUT231 of the third output signal line OUT23 of the second control sub-circuit 10 are all at the low level, and the output signal OUT321 of the second output signal line OUT32 and the output signal OUT331 of the third output signal line OUT33 of the third control sub-circuit 10 are all at the low level. Similarly, when the second clock control signal line CLK2 inputs a turn-on control signal, i.e., a high-level signal, the first clock control signal line CLK1 and the third clock control signal line CLK3 input turn-off control signals, i.e., low-level signals, and the first output signal line and the third output signal line of the third control sub-circuit 10 output low-level signals. When the third clock control signal line CLK3 inputs a turn-on control signal, the first and second clock control signal lines CLK1 and CLK2 input turn-off control signals, i.e., low level signals, and the first and second output signal lines of the three control sub-circuits 10 output low level signals.

It can be understood that while a clock input signal input from the input signal line is a low-level signal, the first output signal line through the third output signal line of the control sub-circuit 10 output low-level signals, regardless of whether the three clock control signal lines CLK1-CLK3 input turn-on control signals or turn-off control signals. Therefore, negative voltage outputs from the first output signal line to the third output signal line in each control sub-circuit 10 can be realized by the inverter.

In addition, according to an embodiment of the present application, a gate drive circuit includes at least one set of gate drive units. Each set of gate drive units includes a first gate drive unit 30 to an $N^{th}$ gate drive unit 30, and each gate drive unit has M clock signal terminals CLKK1-CLKKM. The M control sub-circuits 10 in the clock signal test circuit correspond to the M clock signal terminals CLKK1-CLKKM respectively, and at least two output terminals of each control sub-circuit 10 are respectively connected to clock signal terminals, corresponding to the control sub-circuit 10, of at least two gate drive units 30 in each set of gate drive units.

It can be understood that each control sub-circuit 10 including N control branches L1-LN will be described as an example, the M control sub-circuits 10 correspond to the M clock signal terminals CLKK1-CLKKM of each gate drive unit 30 respectively, for example, the first control sub-circuit 10 corresponds to the first clock signal terminals CLKK1, the second control sub-circuit 10 corresponds to the second clock signal terminals CLKK2, the third control sub-circuit 10 corresponds to the third clock signal terminals CLKK3, and the $M^{th}$ control sub-circuit 10 corresponds to the $M^{th}$ clock signal terminals CLKKM, so the first output signal line OUT11 to the $N^{th}$ output signal line OUT1N of the first control sub-circuit 10 are connected to the first clock signal terminals CLKK1 of the first gate drive unit 30 to the $N^{th}$ gate drive unit 30 respectively. Specifically, the first output signal line OUT11 of the first control sub-circuit 10 is connected to the first clock signal terminal CLKK1 of the first gate drive unit 30, the second output signal line OUT12 of the first control sub-circuit 10 is connected to the first clock signal terminal CLKK1 of the second gate drive unit 30, the third output signal line OUT13 of the first control sub-circuit 10 is connected to the first clock signal terminal CLKK1 of the third gate drive unit 30, and an $N^{th}$ output signal line OUT1N of the first control sub-circuit 10 is connected to the first clock signal terminal CLKK1 of the $N^{th}$ gate drive unit 30.

The first output signal line OUT21 to the $N^{th}$ output signal line OUT2N of the second control sub-circuit 10 are connected to the second clock signal terminals CLKK2 of the first gate drive unit 30 to the $N^{th}$ gate drive unit 30 respectively. Specifically, the first output signal line OUT21 of the second control sub-circuit 10 is connected to the second clock signal terminal CLKK2 of the first gate drive unit 30, the second output signal line OUT22 of the second control sub-circuit 10 is connected to the second clock signal terminal CLKK2 of the second gate drive unit 30, the third output signal line OUT23 of the second control sub-circuit 10 is connected to the second clock signal terminal CLKK2 of the third gate drive unit 30, and an $N^{th}$ output signal line OUT2N of the second control sub-circuit 10 is connected to the second clock signal terminal CLKK2 of the $N^{th}$ gate drive unit 30.

The first output signal line OUTM1 to the $N^{th}$ output signal line OUTMN of the $M^{th}$ control sub-circuit 10 are connected to the $M^{th}$ clock signal terminals CLKKM of the first gate drive unit 30 to the $N^{th}$ gate drive unit respectively. Specifically, the first output signal line OUTM1 of the $M^{th}$ control sub-circuit 10 is connected to the $M^{th}$ clock signal terminal CLKKM of the first gate drive unit 30, the second output signal line OUTM2 of the $M^{th}$ control sub-circuit 10 is connected to the $M^{th}$ clock signal terminal CLKKM of the second gate drive unit 30, the third output signal line OUTM3 of the $M^{th}$ control sub-circuit 10 is connected to the $M^{th}$ clock signal terminal CLKKM of the third gate drive unit 30, and the $N^{th}$ output signal line OUTMN of the $M^{th}$ control sub-circuit 10 is connected to the $M^{th}$ clock signal terminal CLKKM of the $N^{th}$ gate drive unit 30.

As an example, M=N=3, as shown in FIG. 9, three control sub-circuits 10 correspond to three clock signal terminals CLKK1-CLKK3 of each gate drive unit 30 respectively. For example, the first control sub-circuit 10 corresponds to the first clock signal terminal CLKK1, the second control sub-circuit 10 corresponds to the second clock signal terminal CLKK2, the third control sub-circuit 10 corresponds to the third clock signal terminal CLKK3, and the first output signal line OUT11 to the third output signal line OUT13 of the first control sub-circuit 10 are connected to the first clock signal terminals CLKK1 of the first gate drive unit 30 to the third gate drive unit 30 respectively. Specifically, the first output signal line OUT11 of the first control sub-circuit 10 is connected to the first clock signal terminal CLKK1 of the first gate drive unit 30, the second output signal line OUT12 of the first control sub-circuit 10 is connected to the first clock signal terminal CLKK1 of the second gate drive unit 30, and the third output signal line OUT13 of the first control sub-circuit 10 is connected to the first clock signal terminal CLKK1 of the third gate drive unit 30.

Similarly, the first output signal line OUT21 to the third output signal line OUT23 of the second control sub-circuit 10 are connected to the second clock signal terminals CLKK2 of the first gate drive unit 30 to the third gate drive unit 30 respectively. Specifically, the first output signal line OUT21 of the second control sub-circuit 10 is connected to the second clock signal terminal CLKK2 of the first gate drive unit 30, the second output signal line OUT22 of the second control sub-circuit 10 is connected to the second clock signal terminal CLKK2 of the second gate drive unit 30, and the third output signal line OUT23 of the second control sub-circuit 10 is connected to the second clock signal terminal CLKK2 of the third gate drive unit 30.

The first output signal line OUT31 to the third output signal line OUT33 of the third control sub-circuit 10 are connected to the third clock signal terminals CLKK3 of the first gate drive unit 30 to the third gate drive unit 30 respectively. Specifically, the first output signal line OUT31 of the third control sub-circuit 10 is connected to the third clock signal terminal CLKK3 of the first gate drive unit 30, the second output signal line OUT32 of the third control sub-circuit 10 is connected to the third clock signal terminal CLKK3 of the second gate drive unit 30, and the third output signal line OUT33 of the third control sub-circuit 10 is connected to the third clock signal terminal CLKK3 of the third gate drive unit 30.

Therefore, a relatively small number of clock signal channels may be used to function as a relatively large number of clock signal channels, for example, a function of (3×3) clock signal channels can be achieved by (3+3) clock signal channels, further reducing the number of the clock signal channels of the gate drive circuit panel. In addition, investment for the test device can be reduced in the test stage, thereby decreasing the cost effectively and further optimizing the area of peripheral layout.

It should be noted that the clock signal test circuit in accordance with an embodiment of the present application can be used in a test device and inside a display panel, thereby reducing the number of clock signal channels.

To sum up, according to the clock signal test circuit provided by an embodiment of the present application, each control sub-circuit includes at least two control branches, wherein input terminals of the at least two control branches are all connected to the same input signal line, control terminals of the at least two control branches are coupled to at least two of the N clock control signal lines respectively, output terminals of the at least two control branches are connected to at least two output signal lines respectively, and each of the control branches is configured to output a signal input from the input signal line to a corresponding output signal line under the control of a signal input from the corresponding clock control signal line. Herein the number of control branches of at least one of the control sub-circuits is N, both M and N being integers greater than 1; a pull-down sub-circuit includes N pull-down branches, input terminals of the N pull-down branches all receives a first power supply voltage, wherein an output terminal of each of the N pull-down branches is connected to an output signal line of at least one of the control sub-circuits, control terminals of the N pull-down branches are connected to the N clock control signal lines respectively, and each of the pull-down branches is configured to output the first power supply voltage to a corresponding output signal line under the control of a signal input from the corresponding clock control signal line. Therefore, through the clock signal test circuit in accordance with an embodiment of the present application, a relatively small number of clock signal channels may be used to function as a relatively large number of clock signal channels, further reducing the number of clock signal channels of the gate drive circuit panel. For example, a function of 30 clock signals can be achieved by using 13 clock signals. In addition, investment for the test device can be reduced in the test stage, thereby decreasing the cost effectively and optimizing the area of peripheral layout.

Based on the clock signal test circuit in accordance with the above embodiment, an embodiment of the present application also provides a display panel, which includes a gate drive circuit and the aforementioned clock signal test circuit, which is configured to be connected to the gate drive circuit in the test stage.

According to an embodiment of the present application, the gate drive circuit includes at least one set of gate drive units, wherein each set of gate drive units includes a first gate drive unit to an $N^{th}$ gate drive unit, and each gate drive unit has M clock signal terminals. The M control sub-circuits in the clock signal test circuit correspond to the M clock signal terminals respectively, and at least two output terminals of each control sub-circuit are respectively connected to clock signal terminals, corresponding to the control sub-circuit, of at least two gate drive units in each set of gate drive units.

Therefore, a relatively small number of clock signal channels may be used to function as a relatively large number of clock signal channels, for example, a function of (M×N) clock signal channels can be achieved by (M+N) clock signal channels, further reducing the number of the clock signal channels of the gate drive circuit panel, and decreasing the cost and optimizing the area of peripheral layout.

In the display panel provided by the embodiment of the present application, through the clock signal test circuit in accordance with the aforementioned embodiment, a relatively small number of clock signal channels may be used to function as a relatively large number of clock signal channels, further reducing the number of clock signal channels of the gate drive circuit panel. For example, a function of 30 clock signals can be achieved using 13 clock signals. In addition, investment for the test device can be reduced in the test stage, thereby decreasing the cost effectively and optimizing the area of peripheral layout.

Based on the clock signal test circuit in accordance with the above embodiment, an embodiment of the present application also provides a test device, which includes the aforementioned clock signal test circuit.

According to the test device provided by an embodiment of the present application, through the clock signal test circuit in accordance with the aforementioned embodiment, a relatively small number of clock signal channels may be used to function as a relatively large number of clock signal channels, further reducing the number of clock signal channels of the gate drive circuit panel. For example, a function of 30 clock signals can be achieved using 13 clock signals. In addition, investment for the test device can be reduced in the test stage, thereby decreasing the cost effectively and optimizing the area of peripheral layout.

Based on the clock signal test circuit in accordance with the above embodiment, an embodiment of the present application also provides a method for controlling the clock signal test circuit, wherein in the first stage, a signal input from the input signal line is kept at the first level, and the N clock control signal lines input the turn-on control signals sequentially, to enable the at least two control branches in each of the control sub-circuits to be turned on sequentially, wherein while a clock control signal line inputs the turn-on control signal, other clock control signal lines input the turn-off control signals, and the pull-down branches output the first power supply voltage to the corresponding output signal lines under the control of the turn-off control signals input from the clock control signal lines; in the second stage, a signal input from the input signal line is kept at the second level, and each of the output signal lines outputs a second level signal, wherein a voltage at the second level is the same as the first power supply voltage.

The turn-on control signals may be at the high level, and the turn-off control signals may be at the low level.

To sum up, through the clock signal test circuit in accordance with the above embodiment, in the first stage, the signal input from the input signal line is kept at the first level, and the N clock control signal lines input turn-on control signals sequentially, to enable the at least two control branches in each of the control sub-circuits to be turned on sequentially, wherein while one clock control signal line inputs a turn-on control signal, other clock control signal lines input turn-off control signals, and the pull-down branches output the first power supply voltage to the corresponding output signal lines under the control of the turn-off control signals input from the clock control signal lines; in the second stage, a signal input from the input signal line is kept at the second level, and each of the output signal lines outputs the second level signal, wherein a voltage at the second level is the same as the first power supply voltage. Therefore, through the method for controlling the clock signal test circuit in accordance with the aforementioned embodiment, a relatively small number of clock signal channels may be used to function as a relatively large number of clock signal channels, further reducing the number of clock signal channels of the gate drive circuit panel. For example, a function of 30 clock signals can be achieved using 13 clock signals. In addition, investment for the test device can be reduced in the test stage, thereby decreasing the cost effectively and optimizing the area of peripheral layout.

In the description of embodiments of the present disclosure, it should be understood that orientation or position relationships indicated by terms "center", "longitudinal", "transverse", "length", "width", "thickness", "upper", "lower", "front", "back", "left", "right", "vertical", "horizontal", "top", "bottom", "inside", "outside", "clockwise", "counterclockwise", "axial", "radial", "circumferential" and the like are based on the orientation or position relationships shown in the drawings, and are for the convenience of description of the present disclosure and simplification of the description only, but are not intended to indicate or imply that the mentioned device or element must have a specific orientation, or be constructed and operated in a particular orientation, and therefore they should not be construed as limitation on the present disclosure.

In addition, terms "first" and "second" are used for the purpose of description only, and cannot be understood as indication or implication of relative importance or implicit indication of the number of the mentioned technical features. Thus, the features defined by "first" and "second" may include at least one of the features explicitly or implicitly. In the description of the present application, "a plurality of" refers to at least two, for example, two or three, unless specified otherwise.

In the present application, unless otherwise clearly specified and defined, terms "installed", "connected", "coupled", "fixed" and other terms should be broadly understood, for example, to be connected fixedly or connected detachably, or integrated; or to be mechanically connected or electrically connected; or to be directly connected, or be indirectly connected through an intermediary, or be internally connected between two elements or be interacted between two elements, unless otherwise clearly specified. For those of ordinary skill in the art, the specific meaning of the above terms in the present application may be understood according to specific situations.

In the present application, unless otherwise clearly specified and defined, the first feature being "on" or "under" the second feature may mean that the first and second features are in direct contact, or the first and second features are in indirect contact through an intermediary. Moreover, the first feature being "on", "over", and "above" the second feature may mean that the first feature is directly above or obliquely above the second feature, or simply mean that a height of the first feature from a horizon is greater than that of the second feature. The first feature being "under", "below", and "beneath" the second feature may mean that the first feature is directly below or obliquely below the second feature, or simply mean that the horizontal height of the first feature is less than that of the second feature.

In the description of the specification, the reference made to terms "an embodiment," "some embodiments," "an example," "a specific example," or "some examples," means that a specific feature, structure, material, or characteristic described in connection with the embodiment or example is included in at least one embodiment or example of the present application. In this specification, the schematic expression of the above-mentioned terms is not necessarily directed to the same embodiment or example. Moreover, the specific feature, structure, material, or characteristic described may be combined in a proper way in any one or more embodiments or examples. In addition, those skilled in the art may incorporate and combine different embodiments or examples and features of the different embodiments or examples described in this specification without conflict.

Although the embodiments of the present application have been shown and described above, it should be understood that the above embodiments are exemplary, and will not be understood as the limitation to the present application. Alterations, modifications, substitutions and variations to the above embodiments may be made by those skilled in the art within the scope of the present application.

I claim:

1. A clock signal test circuit, comprising:

N clock control signal lines;

M control sub-circuits, each of which comprises at least two control branches, wherein input terminals of the at least two control branches are all connected to a same input signal line, control terminals of the at least two control branches are coupled to at least two of the N clock control signal lines respectively, output terminals of the at least two control branches are connected to at least two output signal lines respectively, and each of the control branches is configured to output a signal input from the input signal line to a corresponding output signal line under control of a signal input from a corresponding clock control signal line, wherein a number of control branches of at least one of the control sub-circuits is N, both M and N being integers greater than 1; and a pull-down sub-circuit comprising N pull-down branches, input terminals of which all receive a first power supply voltage, wherein an output terminal of each of the N pull-down branches is connected to an output signal line of at least one of the control sub-circuits, control terminals of the N pull-down branches are connected to the N clock control signal lines respectively, and each of the pull-down branches is configured to output the first power supply voltage to a corresponding output signal line under control of a signal input from a corresponding clock control signal line.

2. The clock signal test circuit according to claim 1, wherein each of the control sub-circuits comprises N control branches, input terminals of the N control branches are all connected to a same input signal line, control terminals of the N control branches are coupled to the N clock control signal lines respectively, output terminals of the N control branches are connected to N output signal lines respectively, wherein the output terminal of each of the pull-down branches is connected to output signal lines of the M control sub-circuits.

3. The clock signal test circuit according to claim 1, wherein an $i^{th}$ control branch in each of the control sub-circuits comprises an $i^{th}$ transistor, a first electrode of the $i^{th}$ transistor is connected to the input signal line, a second electrode of the $i^{th}$ transistor is connected to an $i^{th}$ output signal line, and a control electrode of the $i^{th}$ transistor is connected to an $i^{th}$ clock control signal line, wherein i is an integer greater than or equal to 1 and less than or equal to N.

4. The clock signal test circuit according to claim 2, wherein an $i^{th}$ pull-down branch in the pull-down sub-circuit comprises:

an inverter, an input terminal of which is connected to the $i^{th}$ clock control signal line; and an $(N+i)^{th}$ transistor, wherein a first electrode of the $(N+i)^{th}$ transistor is connected to a first power supply providing the first power supply voltage, a second electrode of the $(N+i)^{th}$ transistor is connected to an output signal line of at least one of the control sub-circuits, and a control electrode of the $(N+i)^{th}$ transistor is connected to an output terminal of the inverter.

5. The clock signal test circuit according to claim 4, wherein the inverter comprises:

a $(2N+1)^{th}$ transistor, a first electrode and a control electrode of the $(2N+1)^{th}$ transistor being connected to a second power supply; and a $(2N+2)^{th}$ transistor, wherein a control electrode of the $(2N+2)^{th}$ transistor serves as the input terminal of the inverter, a first electrode of the $(2N+2)^{th}$ transistor is connected to a second electrode of the $(2N+1)^{th}$ transistor and then serves as the output terminal of the inverter, and a second electrode of the $(2N+2)^{th}$ transistor is connected to a third power supply.

6. The clock signal test circuit according to claim 4, wherein the inverter comprises:

a $(2N+3)^{th}$ transistor, a first electrode and a control electrode of the $(2N+3)^{th}$ transistor being connected to a second power supply;

a $(2N+4)^{th}$ transistor, wherein a first electrode of the $(2N+4)^{th}$ transistor is connected to a second electrode of the $(2N+3)^{th}$ transistor, and a second electrode of the $(2N+4)^{th}$ transistor is connected to a third power supply;

a $(2N+5)^{th}$ transistor, wherein a first electrode of the $(2N+5)^{th}$ transistor is connected to the second power supply, and a control electrode of the $(2N+5)^{th}$ transistor is connected to the second electrode of the $(2N+3)^{th}$ transistor; and a $(2N+6)^{th}$ transistor, wherein a control electrode of the $(2N+6)^{th}$ transistor is connected to a control electrode of the $(2N+4)^{th}$ transistor and then serves as the input terminal of the inverter, a first electrode of the $(2N+6)^{th}$ transistor is connected to a second electrode of the $(2N+5)^{th}$ transistor and then serves as the output terminal of the inverter, and a second electrode of the $(2N+6)^{th}$ transistor is connected to the third power supply.

7. A display panel, comprising:

a gate drive circuit; and the clock signal test circuit according to claim 1, which is configured to be connected to the gate drive circuit in a test stage.

8. The display panel according to claim 7, wherein the gate drive circuit comprises at least one set of gate drive units, each set of gate drive units comprises a first gate drive unit to an $N^{th}$ gate drive unit, and each gate drive unit has M clock signal terminals; and the M control sub-circuits in the clock signal test circuit correspond to the M clock signal terminals respectively, and at least two output terminals of each control sub-circuit are respectively connected to clock signal terminals, corresponding to the control sub-circuit, of at least two gate drive units in each set of gate drive units.

9. A test device, comprising the clock signal testing circuit according to claim 1.

10. A method for controlling the clock signal test circuit according to claim 1, wherein in a first stage, a signal input from the input signal line is kept at a first level, and the N clock control signal lines input turn-on control signals sequentially, to enable the at least two control branches in each of the control sub-circuits to be turned on sequentially, wherein while a clock control signal line inputs the turn-on control signal, other clock control signal lines all input turn-off control signals, and the pull-down branches output the first power supply voltage to corresponding output signal lines under control of the turn-off control signals input from the clock control signal lines; and in a second stage, a signal input from the input signal line is kept at a second level, and each of the output signal lines outputs a second level signal, wherein a voltage at the second level is same as the first power supply voltage.

* * * * *